US008373605B2

(12) United States Patent
Berenguer et al.

(10) Patent No.: US 8,373,605 B2
(45) Date of Patent: Feb. 12, 2013

(54) ELECTROMAGNETIC ANTENNA RECONFIGURABLE BY ELECTROWETTING

(75) Inventors: Marc Berenguer, Revel (FR); Emmanuel Dreina, Meylan (FR); Michel Pons, Meylan (FR)

(73) Assignee: France Telecom, Paris (FR)

( * ) Notice: Subject to any disclaimer, the term of this patent is extended or adjusted under 35 U.S.C. 154(b) by 215 days.

(21) Appl. No.: 12/741,391

(22) PCT Filed: Nov. 4, 2008

(86) PCT No.: PCT/FR2008/051987

§ 371 (c)(1),
(2), (4) Date: May 5, 2010

(87) PCT Pub. No.: WO2009/068774

PCT Pub. Date: Jun. 4, 2009

(65) Prior Publication Data

US 2010/0265143 A1 Oct. 21, 2010

(30) Foreign Application Priority Data

Nov. 8, 2007 (FR) ..... 07 58890

(51) Int. Cl.
*H01Q 1/24* (2006.01)
*H01Q 1/36* (2006.01)

(52) U.S. Cl. ..... 343/702

(58) Field of Classification Search ..... 343/700 MS, 343/702, 769, 701
See application file for complete search history.

(56) References Cited

U.S. PATENT DOCUMENTS

| | | | | |
|---|---|---|---|---|
| 2002/0154380 | A1 * | 10/2002 | Gelbart | 359/290 |
| 2004/0252069 | A1 * | 12/2004 | Rawnick et al. | 343/789 |
| 2005/0057415 | A1 * | 3/2005 | Rawnick et al. | 343/795 |
| 2006/0220959 | A1 * | 10/2006 | Ying | 343/700 MS |
| 2007/0080873 | A1 * | 4/2007 | Candal et al. | 343/702 |
| 2007/0216595 | A1 | 9/2007 | Hashiyama et al. | |
| 2007/0229363 | A1 | 10/2007 | Kurashima et al. | |

FOREIGN PATENT DOCUMENTS

| | | | |
|---|---|---|---|
| FR | 2 769 375 | A | 4/1999 |
| GB | 2 436 168 | A | 9/2007 |
| GB | 2436168 | A * | 9/2007 |
| WO | WO 2004/099844 | A1 | 11/2004 |
| WO | WO 2004/0998844 | A1 * | 11/2004 |
| WO | WO 2006/092804 | A2 | 9/2006 |

OTHER PUBLICATIONS

Avdeyev et al., "A Lens with Controlled Refractive Index for Millimeter-Wavelength Antennas," Telecommunications and Radio Engineering, Scripta Technica, Inc., New York, NY, US, vol. 41/42 (6), pp. 105-106 (Jun. 1, 1987).

* cited by examiner

*Primary Examiner* — Douglas W Owens
*Assistant Examiner* — Collin Dawkins
(74) *Attorney, Agent, or Firm* — Drinker Biddle & Reath LLP

(57) ABSTRACT

The invention relates to an electromagnetic antenna that comprises a radiating element composed of a first, electrically conducting, fluid substance ($F_1$) sitting on a first element ($S_1$) and of a second fluid substance ($F_2$) sitting on a second element ($S_2$), the first fluid substance ($F_1$) being in contact with the second fluid substance ($F_2$), said fluid substances being immiscible and said first and second elements being electrically conducting and electrically isolated from one another.

10 Claims, 7 Drawing Sheets

ELECTROMAGNETIC ANTENNA RECONFIGURABLE BY ELECTROWETTING

CROSS-REFERENCE TO RELATED APPLICATIONS

This application is the U.S. national phase of the International Patent Application No. PCT/FR2008/051987 filed Nov. 4, 2008, which claims the benefit of French Application No. 07 58890 filed Nov. 8, 2007, the entire content of which is incorporated herein by reference.

FIELD OF INVENTION

The present invention belongs to the field of electromagnetic antennas. More precisely, the invention relates to an antenna that is reconfigurable by electrowetting.

BACKGROUND

Conventionally, an electromagnetic antenna is composed of a radiating element, a dielectric and a ground plane. The radiating element and the ground plane are most commonly metal. They are of very diverse shapes and dimensions.

In radio systems of the software radio type, such as SDR (for Software Defined Radio in English) or SR (for Software Radio), the terminals and/or communicating objects are limited in size and weight and have a poor energy autonomy. These terminals and/or communicating objects require antennas which are miniaturized, on the one hand, and that, on the other, can satisfy a set of constraints associated with the radio system. For example, these antennas must be able to simultaneously cover all the frequencies of a wide frequency band or, as a minimum, these antennas must be very flexible in frequency in order to be able to scan a wide spectrum of frequencies.

In order to satisfy this set of constraints, antennas referred to as "reconfigurable" have been designed.

At least three types of reconfigurable antennas are currently available as presented hereinbelow.

Antenna Reconfigurable in Frequency:

The antenna is then called frequency-flexible. The antenna can thus scan a wide spectrum of frequencies. Such antennas are used in mobile terminals which can be compatible with several communications standards such as the GSM standard (for Global System for Mobile Communications in English) which relates to a frequency band around 900 MHz and the UMTS standard (for Universal Mobile Telecommunications System in English) which relates to a frequency band around 1800 MHz.

Antenna Reconfigurable in Polarization:

The antenna is then referred to as polarization-flexible. For a linear polarization, this polarization may be horizontal or vertical, and for a circular polarization, this may be left or right. Such antennas provide a better signal-to-noise ratio and are particularly advantageous in locations where the propagation of electromagnetic waves encounters numerous obstacles, such as for example inside buildings.

Antenna Reconfigurable in Radiation Pattern:

The antenna is then capable of modifying its radiation pattern in order, for example, to adapt to a change in the propagation environment.

In the current prior art, in view of the dimensional constraints, the reconfiguration of an antenna is not achieved by a mechanical or geometric deformation of the antenna or of the elements composing it.

In fact, the reconfiguration of an antenna is currently achieved by switching certain elements within the radiating element, the dielectric and the ground plane that compose it, or by varying impedances connected to certain points on the antenna.

These two modes of reconfiguration present certain drawbacks.

In the case where elements of the antenna are switched, a discontinuous variation of the characteristics that it is desired to reconfigure (frequency, directivity of the radiation) is obtained.

In the case where impedances connected to certain points on the antenna are varied, a continuous variation in frequency is obtained but limited by the ranges of variation of the impedances used. For the same reasons, the continuous variations of the radiation pattern are limited.

The combination of the two types of reconfiguration (by switching of elements and by variation of impedances) allows variations of the physical characteristics in question to be obtained over wider ranges but with an increased complexity that tends to be incompatible with the design constraints (dimensions, weight, energy autonomy) of the terminals and/or the communicating objects in question.

Furthermore, the elements (switches and impedances) enabling the reconfiguration exhibit intrinsic losses which affect the efficiency of the antenna.

There is therefore a real need for a technique for reconfiguring an electromagnetic antenna which does not exhibit the aforementioned drawbacks of the known reconfiguration techniques.

SUMMARY

Thus, according to a first aspect, the present invention relates to an electromagnetic antenna that is noteworthy in that it comprises a radiating element composed of a first, electrically conducting, fluid substance sitting on a first element and of a second fluid substance sitting on a second element, the first fluid substance being in contact with the second fluid substance, said fluid substances being immiscible and said first and second elements being electrically conducting and electrically isolated from one another.

The antenna according to the invention has the advantage of comprising a radiating element which, instead of being made of metal, is composed of a fluid substance being deformable by nature.

According to a preferred feature, the first fluid substance is a substance made electrically conducting by the introduction into this substance of particles or of fragments of a conducting element or by the introduction into this substance of a conducting substance.

The introduction into the fluid substance of fragments of a conducting element endows the radiating element (fluid substance and fragments) with particular electromagnetic properties. Thus, the resonant frequency is no longer necessarily fixed by the dimensions and the volume of the fluid substance but can equally depend on potential folding effects of the fragments whose deployed lengths may be very significant. This thus allows operation of the antenna in frequency bands that are much lower than in the case of a simple fluid substance.

According to a preferred feature, the second element is composed of an assembly of sub-elements electrically isolated from one another.

The decomposition of the second element into sub-elements facilitates and allows an improved control of the deformation of the assembly. It is possible to obtain an asymmetric deformation.

According to a preferred feature, the contact surfaces of the first and of the second element with the first and the second fluid substance, respectively, are planar or concave or convex.

The shape adopted by the contact surface of the elements with the fluid substances, in particular when the latter is concave, allows the effects due to the weight of the fluid substance (gravity effects) to be compensated, the size of the antenna to be increased and hence enables the use thereof in lower frequency bands.

According to a preferred feature, at least one of the contact surfaces of the first and of the second element with the first and the second fluid substance, respectively, is coated with a layer of insulating material.

Thus, the introduction of a layer of insulating material allows the fluid substances to be isolated and chemical reactions between the fluid substances and the contact surfaces of the elements with the fluid substances to be avoided.

A greater flexibility in the choice of the materials forming the first and second elements is also obtained.

According to a preferred feature, the contours and the volume of the first fluid substance are deformed in a reversible manner by application of a potential difference between the first and the second element.

The deformation of the contours and of the volume of the first fluid substance can be slow and progressive. In view of the flexibility of the substances forming the antenna, this deformation is reversible. Since the deformation is continuous, the reconfiguration of the antenna is also continuous, progressive and reversible. These features greatly enhance the adaptability of the antenna.

According to a preferred feature, the contours and the volume of the first fluid substance are deformed by application of a plurality of potential differences between the first element and each of the sub-elements of the second element.

Since the second element can be decomposed into sub-elements, the deformation of the contours and of the volume of the first fluid substance can be asymmetric. The reconfiguration of the antenna, in particular in polarization and in radiation pattern, is greatly improved.

According to a preferred feature, the antenna according to the invention comprises a protection cover enclosing the first element, the second element, the first fluid substance and the second fluid substance.

The invention also relates to a method for reconfiguring an antenna such as previously described, said method comprising an operation for deforming the contours and the volume of the first fluid substance by application of at least one potential difference between the first and the second element.

A method for reconfiguration of an antenna according to the invention has the advantage of being continuous, progressive and reversible.

The invention also relates to a radiocommunications terminal comprising an antenna such as described hereinabove.

BRIEF DESCRIPTION OF THE DRAWINGS

Other features and advantages of the invention will become apparent upon reading preferred embodiments, described with reference to the appended figures in which.

DETAILED DESCRIPTION

Figure 1:
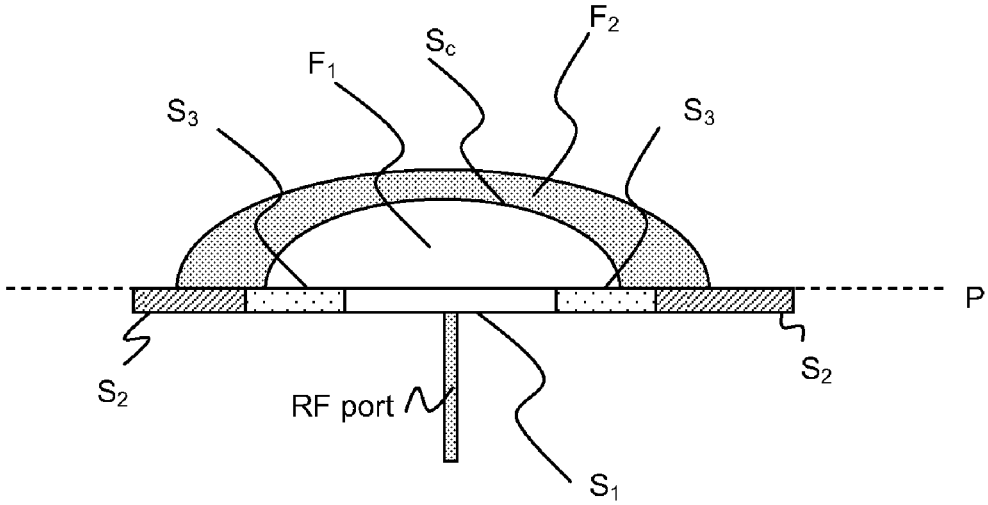
FIG. 1 shows a longitudinal cross-sectional view of an antenna according to a first embodiment of the invention.

FIG. 1 shows a longitudinal cross-sectional view of an antenna according to a first embodiment of the invention.

The antenna shown in FIG. 1 comprises an RF (radiofrequency) port for the emission and the reception of signals.

The RF port is connected to a first electrically conducting element $S_1$.

In the same plane P, the first element $S_1$ is surrounded by an insulating third element $S_3$ which separates it from a second electrically conducting second element $S_2$, the second element $S_2$ surrounding the third element $S_3$.

A first highly electrically conducting fluid substance $F_1$ sits on the first element $S_1$. As shown in FIG. 1, the first fluid substance $F_1$ is also in contact with a part of the third element $S_3$.

The first fluid substance $F_1$ has a surface tension comparable with that of oil. By way of example, the first fluid substance $F_1$ can be a liquid, a body in a solid-liquid transition phase or else a soft and flowing material, of the polymer type.

The volume of the first fluid substance $F_1$ is small and may, by way of example, be similar to that of a droplet.

A second fluid substance $F_2$ sits on the second element $S_2$. As is shown in FIG. 1, the second fluid substance $F_2$ is also in contact with a part of the third element $S_3$.

The second fluid substance $F_2$ has a surface tension comparable with that of water. By way of example, the second fluid substance $F_2$ can be water or a liquid having properties comparable with those of water.

The first and second fluid substances $F_1$ and $F_2$ are immiscible.

The first and second fluid substances $F_1$ and $F_2$ are in contact via a contact surface $S_c$. In the particular embodiment of the invention shown in FIG. 1, the second fluid substance $F_2$ covers the first fluid substance $F_1$.

Figure 2:
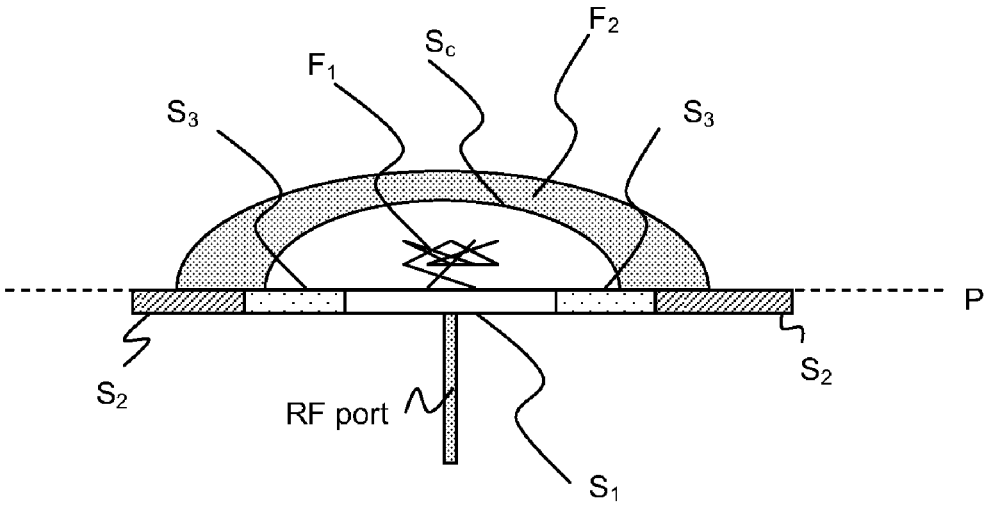
FIG. 2 shows a variant embodiment of the antenna shown in FIG. 1.

According to a variant embodiment shown in FIG. 2, the first fluid substance $F_1$ is made electrically conducting by the introduction into this substance of particles or fragments of a conducting element. These particles or fragments may be carbon nanotubes or other conducting filaments. These particles or fragments can be in suspension in the first fluid substance $F_1$ or adhere to the first element $S_1$ by way of a flexible and conducting connection means.

According to another variant embodiment not shown, the first fluid substance $F_1$ is made electrically conducting by the introduction of a conducting fluid substance mixed with the first fluid substance $F_1$.

Figure 3:
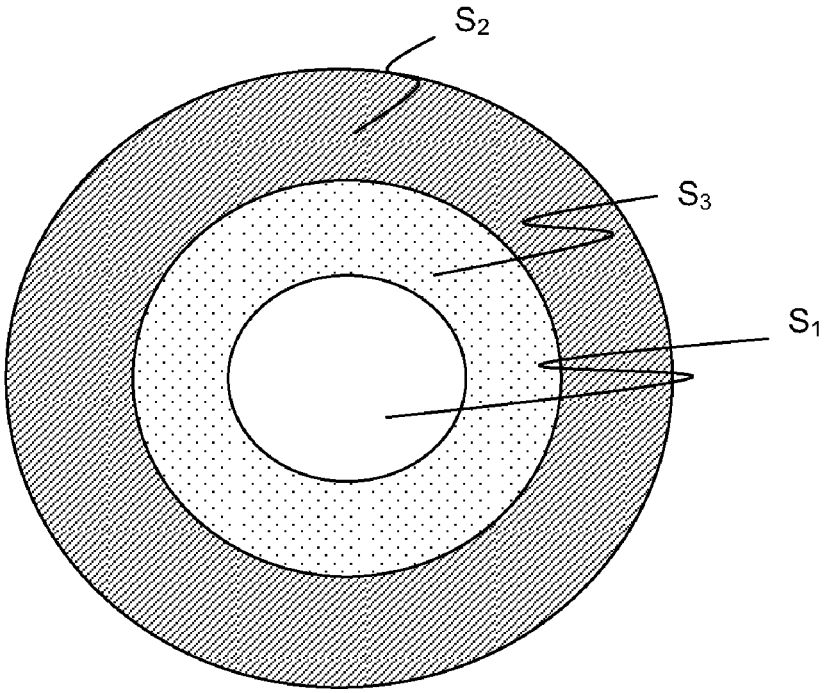
FIG. 3 shows a transverse cross-sectional view through a plane P for a particular embodiment of the antenna shown in FIG. 1.

FIG. 3 shows a transverse cross-sectional view through the plane P of a particular embodiment of the antenna in which the first element $S_1$ is a disk and the second and third elements $S_2$ and $S_3$ are rings with the same center as that of the disk $S_1$.

Figure 4:
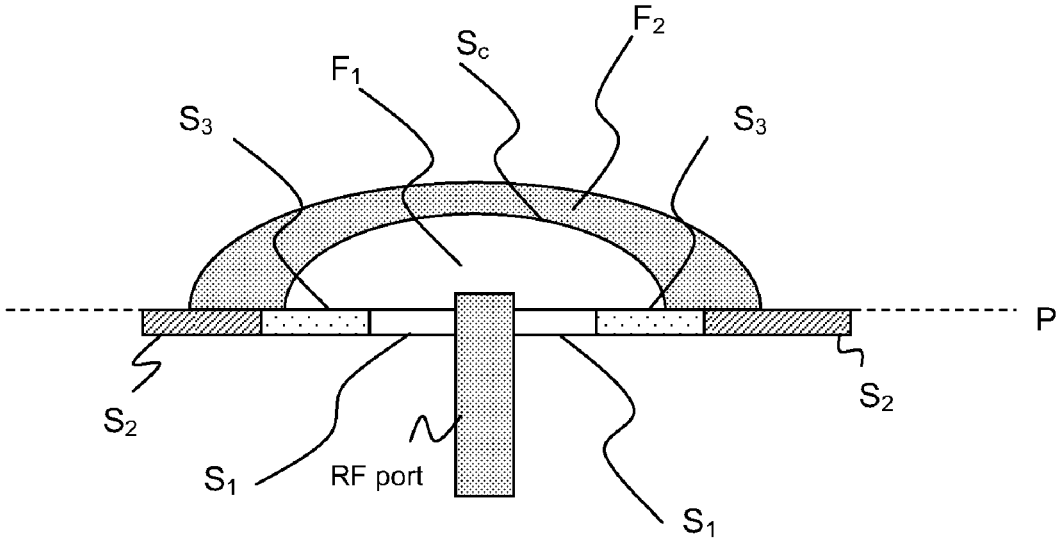
FIG. 4 shows a longitudinal cross-sectional view of an antenna according to a second embodiment of the invention.

FIG. 4 shows a longitudinal cross-sectional view of an antenna according to another embodiment of the invention in which the first, second, and third elements $S_1$, $S_2$ and $S_3$ are concentric rings. In this case, the RF port is in direct contact with the first fluid substance $F_1$.

Other shapes may however be envisioned for the first, second, and third elements $S_1$, $S_2$ and $S_3$.

Figure 5:
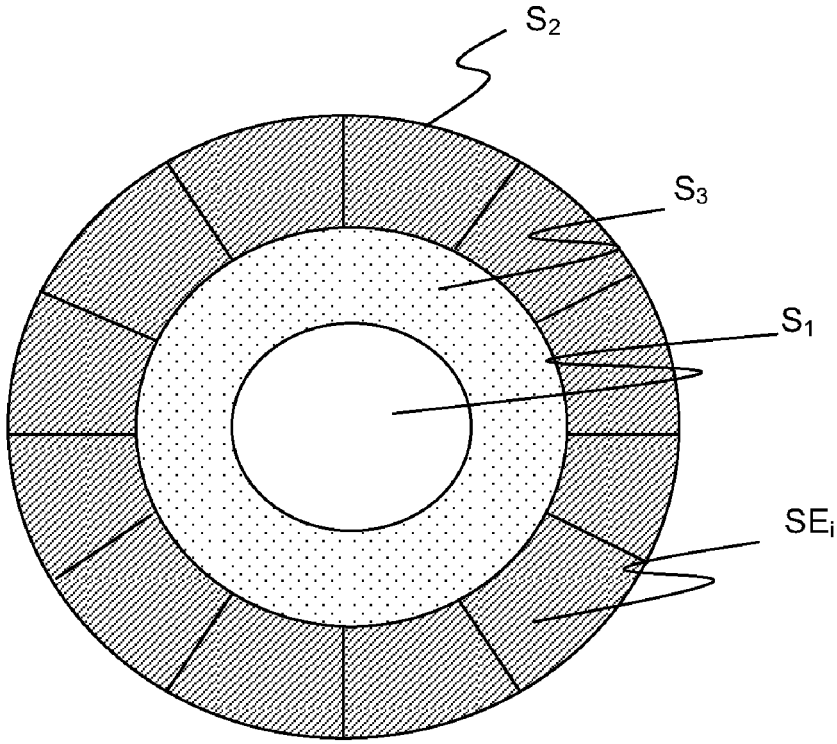
FIG. 5 shows a transverse cross-sectional view through the plane P of a variant embodiment of an antenna such as that shown in FIG. 3.

FIG. 5 shows a transverse cross-sectional view through the plane P of a variant embodiment of an antenna in which the second element $S_2$ is composed of an assembly of n sub-elements $SE_1$ with i varying from 1 to n. The sub-elements SE, are electrically isolated from one another.

The surface formed by the surfaces of the first, second, and third elements $S_1$, $S_2$ and $S_3$ in contact with the first and second fluid substances $F_1$ and $F_2$ can be planar such as those shown in FIGS. 1, 2 and 4. It may also be concave (for example, so as to form a kind of bowl) or convex.

When the surface formed by the surfaces of the first, second, and third elements $S_1$, $S_2$ and $S_3$ in contact with the first and second fluid substances $F_1$ and $F_2$ is convex, the radius of curvature must be less than a certain threshold. If this threshold is exceeded, the effects of gravity acting on the fluid substances may cause the outer "envelope" of these fluid substances to tear. The fluid substances are transformed into droplets at the contact with the convex surface formed from the surfaces of the first, second, and third elements $S_1$, $S_2$ and $S_3$.

When the surface formed by the surfaces of the first, second, and third elements $S_1$, $S_2$ and $S_3$ in contact with the first and second fluid substances $F_1$ and $F_2$ is concave, the volume and the dimensions of the fluid substances are increased, in particular the dimension of the contact surface $S_c$. In addition, the effects of gravity are compensated, thus limiting the impact of the weight of the fluid substance on its behavior.

In one particular embodiment of the invention, at least one of the surfaces of the first, second, and third elements $S_1$, $S_2$ and $S_3$ in contact with the first and second fluid substances $F_1$ and $F_2$ is coated with a thin layer of an insulating material.

This thin layer allows the first and second fluid substances $F_1$ and $F_2$ to be isolated and thus chemical reactions between the first and second fluid substances $F_1$ and $F_2$ and the surfaces of the first, second, and third elements $S_1$, $S_2$ and $S_3$ to be avoided.

This solution also allows a greater flexibility in the choice of the materials forming, in particular, the first and second elements $S_1$ and $S_2$.

The invention also relates to a method for reconfiguring an antenna according to the invention.

Figure 6:
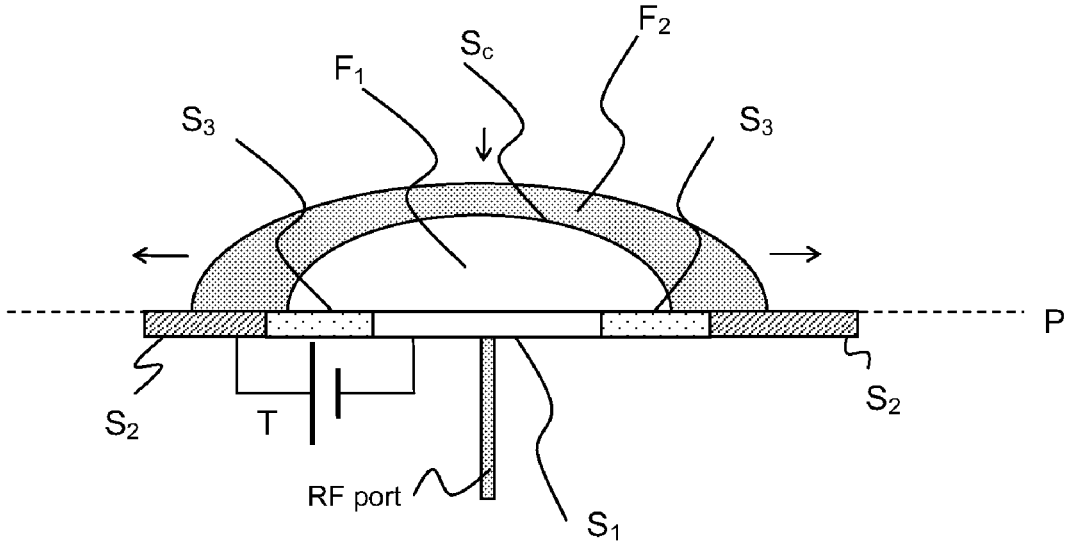
FIG. 6 illustrates the application of a reconfiguration method according to the invention to an antenna according to the invention.

FIG. 6 illustrates the application of a reconfiguration method according to the invention to an antenna according to the invention.

In FIG. 6, a source of voltage T is connected to the second element $S_2$ of an antenna such as previously described.

By applying a DC voltage to the second element $S_2$, in other words a steady potential difference between the first and second elements $S_1$ and $S_2$, the energy between the second fluid substance $F_2$ and the contact surface $S_c$ is modified. The volume occupied by the second fluid substance $F_2$ is then deformed and the contours of this second fluid substance $F_2$ are displaced.

The displacement of the contours of the second fluid substance $F_2$ leads to the displacement of the contours of the first fluid substance $F_1$ with which it is in contact. The volume occupied by the first fluid substance $F_1$ is in turn then deformed. This displacement and this deformation lead to a modification of the characteristics of the first fluid substance $F_1$ from the point of view of electromagnetic radiation.

The arrows drawn in FIG. 6 represent the direction of displacement of the contours and the deformation of the first and second fluid substances $F_1$ and $F_2$.

An antenna that is reconfigurable by deformation of the contours and of a volume of a conducting fluid substance is thus obtained.

This reconfiguration is possible in frequency and in radiation pattern.

Generally speaking, the phenomenon of deformation and of displacement of the contours of a fluid substance in contact with a surface to which an electrical voltage is applied corresponds to the phenomenon referred to as "electrowetting".

Figure 7A:
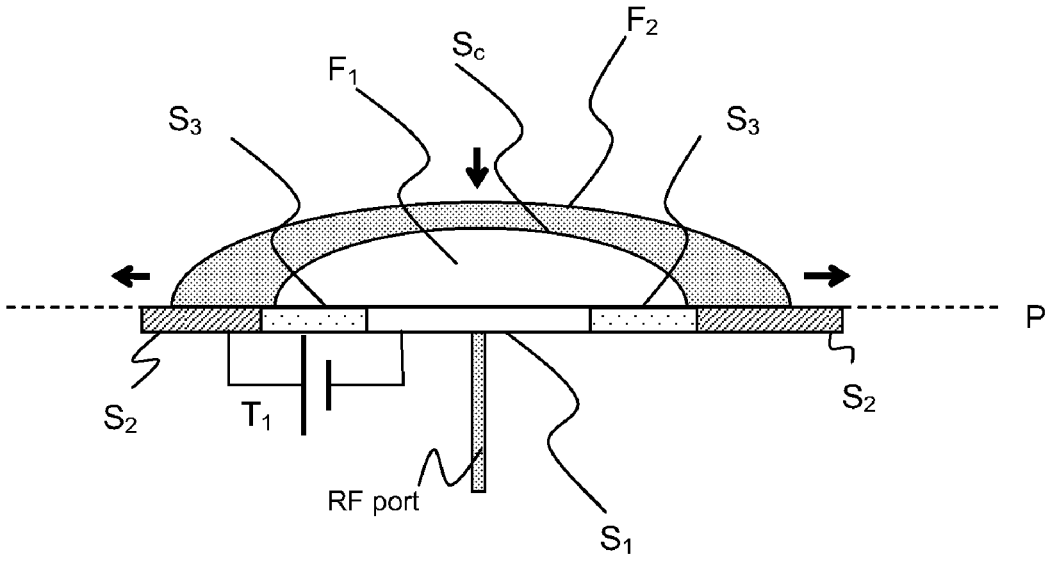
FIGS. 7*a* and 7*b* illustrate other examples of application of the reconfiguration method according to the invention.

FIG. 7*a* illustrates an example of application of the reconfiguration method according to the invention. A deformation, represented by the arrows, of the contours and volumes of the first and second fluid substances $F_1$ and $F_2$ is obtained by the application of a voltage $T_1$. In this example, the deformation produced leads to the formation of a substantial radiating length and hence to a relatively low frequency of operation.

Figure 7B:
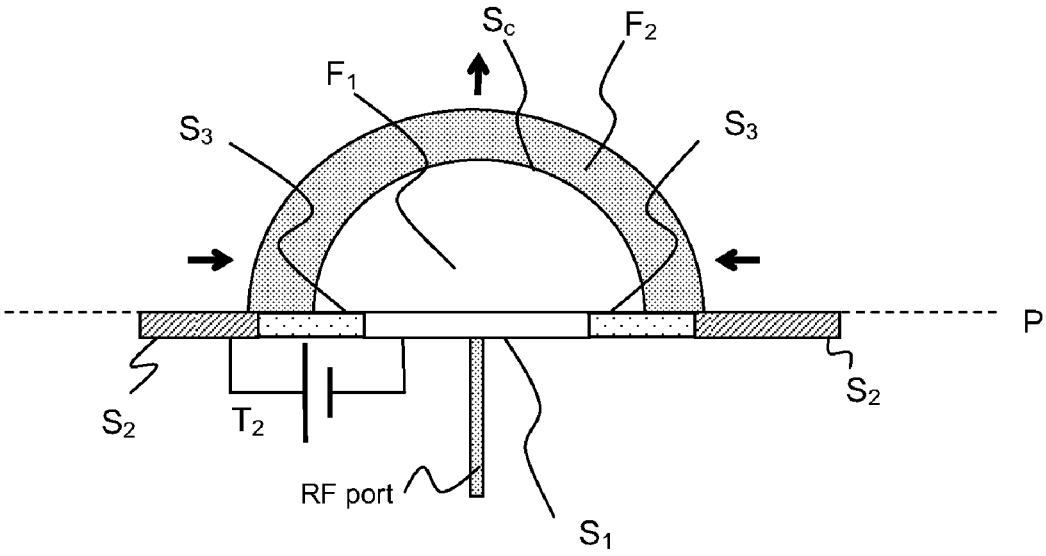

FIG. 7*b* illustrates another example of application of the reconfiguration method according to the invention. A deformation, represented by the arrows, of the contours and volumes of the first and second fluid substances $F_1$ and $F_2$ is obtained by the application of a voltage $T_2$ different from $T_1$. In this new example, the deformation produced leads to the formation of a shorter radiating length than in the preceding example and hence to a higher frequency of operation.

These two examples illustrate the capacity for reconfiguration in frequency of the antenna according to the invention.

When the second element $S_2$ is composed of an assembly of n sub-elements SE, with i varying from 1 to n (embodiment shown in FIG. 5), it is then possible to apply different potential differences between the element $S_1$ and each of the sub-elements of the second element $S_2$. A non-uniform or asymmetric deformation of the volume of the first fluid substance $F_1$ can thus be obtained. This type of deformation enables a reconfiguration of the antenna in polarization to be obtained, in addition to the reconfigurations still possible in frequency and in radiation pattern.

Figure 8A:
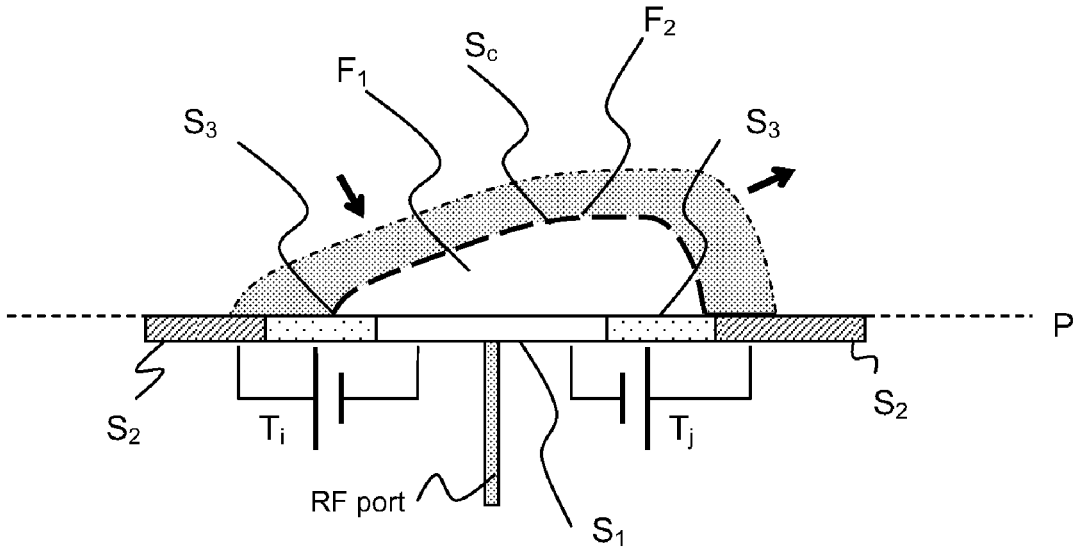
FIG. 8*a* illustrates another example of application of the reconfiguration method according to the invention.

FIG. 8*a* illustrates another example of application of the reconfiguration method according to the invention. In this example, an asymmetric deformation of the contours and volumes of the first and second fluid substances $F_1$ and $F_2$ is obtained by application of different voltages $T_i$ and $T_j$ for two sub-elements $SE_i$ and $SE_j$, respectively, of the second element $S_2$.

Figure 8B:
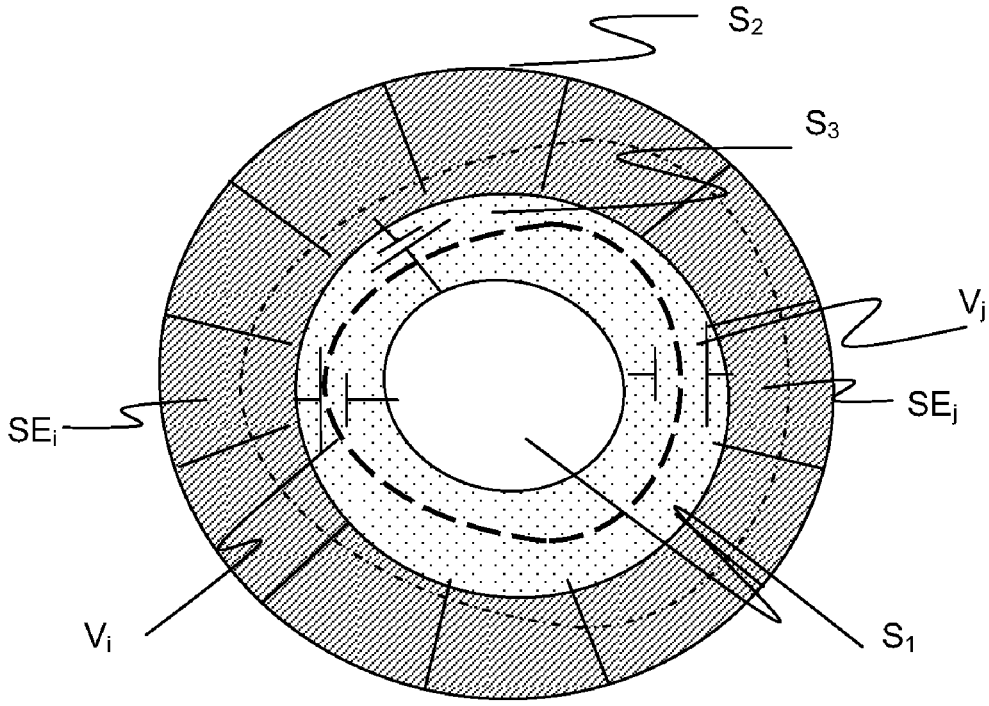
FIG. 8*b* illustrates, according to a transverse cross-sectional view through the plane P, the example of application of the reconfiguration method according to the invention in FIG. 8*a*, FIGS. 9*a* and 9*b* illustrate other examples of application of the reconfiguration method according to the invention.

FIG. 8*b* illustrates, according to a transverse cross-sectional view through the plane P, the preceding example of application of the reconfiguration method according to the invention such as illustrated in FIG. 8*a*.

Figure 9A:
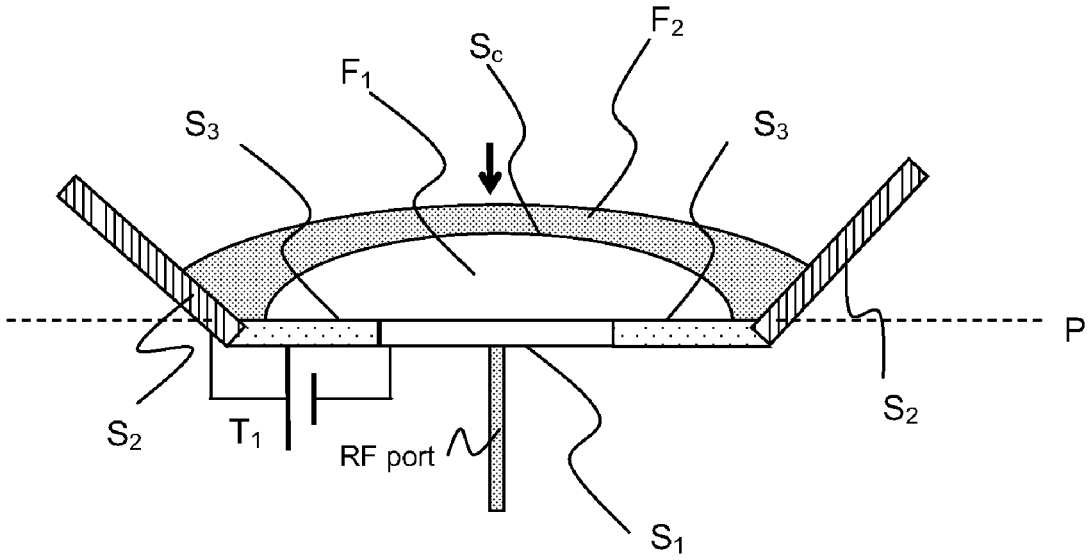
Figure 9B:
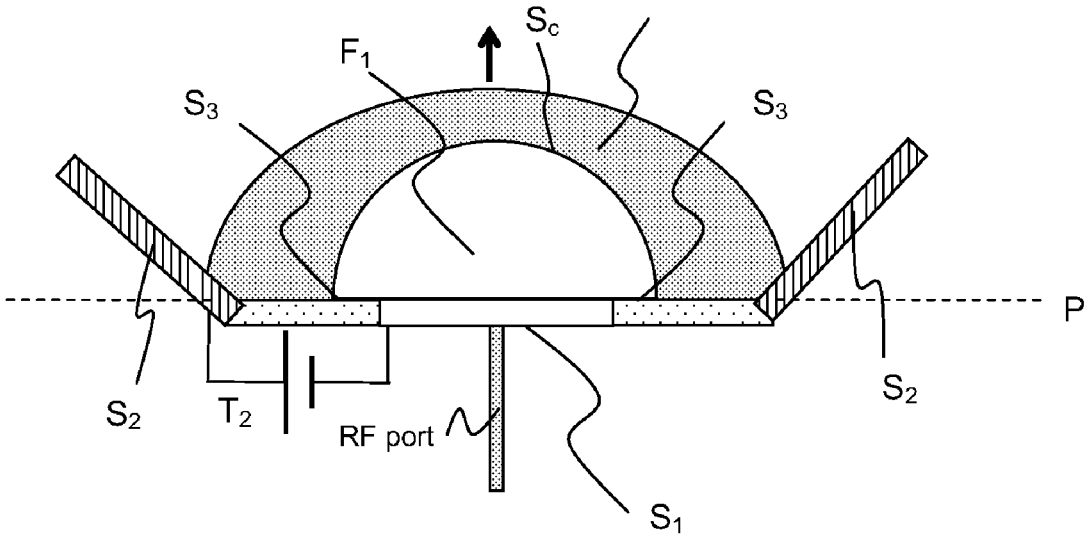

FIGS. 9*a* and 9*b* illustrate other examples of application of the reconfiguration method according to the invention.

FIGS. 9*a* and 9*b* illustrate examples of application of the reconfiguration method according to the invention similar to those shown in FIGS. 7*a* and 7*b*, respectively, but for which the surface formed by the surfaces of the first, second, and third elements $S_1$, $S_2$ and $S_3$ in contact with the first and second fluid substances $F_1$ and $F_2$ is concave.

When the surface formed by the surfaces of the first, second, and third elements $S_1$, $S_2$ and $S_3$ in contact with the first and second fluid substances $F_1$ and $F_2$ is concave (for example, so as to form a kind of bowl), a part of this surface (that which forms the edges of the bowl and which corresponds notably to the surface of the second element $S_2$) allows the deformation of the volume of the second fluid substance $F_2$ to be mechanically controlled and the effects of gravity to be compensated, thus enhancing the quality of the antenna obtained.

The possibility of being able to vary in a continuous manner the potential difference (or differences) between the first and second elements $S_1$ and $S_2$ (or the sub-elements of the second element $S_2$) enables a reversible deformation of the contours and of the volume of the first fluid substance $F_1$ and a continuous variation of the characteristics of the antenna (frequency, polarization, directivity of the radiation) to be obtained.

Figure 10:
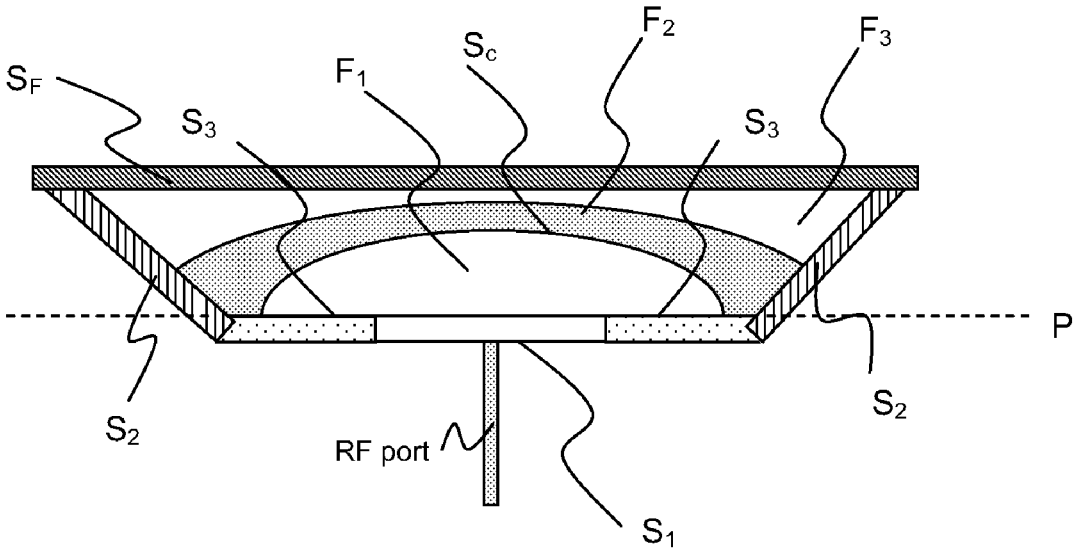
FIG. 10 shows an antenna according to the invention equipped with a protection cover.

FIG. 10 shows an antenna according to the invention equipped with a protection cover.

The protection cover provides an enclosure for the various elements composing the antenna such as the first, second, and third elements $S_1$, $S_2$ and $S_3$ and the first and second fluid substances $F_1$ and $F_2$.

The protection cover is formed from solid walls.

These walls are permeable to the radiation of electromagnetic waves by the antenna with a minimum of losses.

In one particular embodiment, such as that shown in FIG. 10, the walls are composed of the surfaces of the first, second, and third elements $S_1$, $S_2$ and $S_3$ and of a surface $S_F$ enclosing the whole of the device.

In one particular embodiment, the protection cover can also enclose a third fluid substance $F_3$ which is immiscible with the first and second fluid substances $F_1$ and $F_2$. This third fluid substance $F_3$ allows the empty spaces between the walls of the protection cover and the elements that it encloses to be filled.

The invention also relates to a radiocommunications terminal or any communicating object capable of accepting an antenna according to the invention.

The invention claimed is:

1. An electromagnetic antenna comprising a radiating element comprising a first, electrically conducting, fluid substance disposed in contact with a first element and a second fluid substance disposed in contact with a second element, the first fluid substance being in contact with the second fluid substance, said first and second fluid substances being immiscible and said first and second elements being electrically conducting and electrically isolated from one another.

2. The antenna as claimed in claim 1, wherein the first fluid substance is a substance made electrically conducting by the introduction into the first fluid substance of particles or fragments of a conducting element or by the introduction into the first fluid substance of a conducting substance.

3. The antenna as claimed in claim 1, wherein the second element is composed of an assembly of sub-elements electrically isolated from one another.

4. The antenna as claimed in claim 1, wherein the contact surfaces of the first and of the second element with the first and the second fluid substance, respectively, are planar or concave or convex.

5. The antenna as claimed in claim 1, wherein at least one of the contact surfaces of the first and of the second element with the first and the second fluid substance, respectively, is coated with a layer of insulating material.

6. The antenna as claimed in claim 1, wherein the contours and the volume of the first fluid substance are deformed in a reversible manner by application of a potential difference between the first and the second element.

7. The antenna as claimed in claim 3, wherein the contours and the volume of the first fluid substance are deformed by application of a plurality of potential differences between the first element and each of the sub-elements of the second element.

8. The antenna as claimed in claim 1, said antenna comprising a protection cover enclosing the first element, the second element, the first fluid substance and the second fluid substance.

9. A method for reconfiguration of an antenna as claimed in claim 1, said method comprising an operation for deforming the contours and the volume of the first fluid substance by application of at least one potential difference between the first and the second element.

10. A radiocommunications terminal comprising an antenna as claimed in claim 1.

* * * * *